US009933754B2

(12) United States Patent
Dubach et al.

(10) Patent No.: US 9,933,754 B2
(45) **Date of Patent: *Apr. 3, 2018**

(54) NICKEL-FREE ZIRCONIUM AND/OR HAFNIUM-BASED BULK AMORPHOUS ALLOY

(71) Applicant: The Swatch Group Research and Development Ltd, Marin (CH)

(72) Inventors: Alban Dubach, Bienne (CH); Yves Winkler, Schmitten (CH); Tommy Carozzani, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/188,588

(22) Filed: Jun. 21, 2016

(65) Prior Publication Data

US 2017/0038733 A1 Feb. 9, 2017

(30) Foreign Application Priority Data

Aug. 3, 2015 (EP) ..... 15179473

(51) Int. Cl.

| | |
|---|---|
| ***G04B 37/22*** | (2006.01) |
| ***C22C 45/10*** | (2006.01) |
| ***C22C 1/00*** | (2006.01) |

(52) U.S. Cl.

CPC ..... *G04B 37/22* (2013.01); *C22C 1/002* (2013.01); *C22C 45/10* (2013.01)

(58) Field of Classification Search

CPC ..... G04G 37/22; C22C 1/002; C22C 45/10; G04B 37/22

See application file for complete search history.

(56) References Cited

U.S. PATENT DOCUMENTS 4,148,669 A * 4/1979 Tanner ..... H01C 3/005 148/538
4,668,310 A * 5/1987 Kudo ..... H01F 1/153 148/304

(Continued)

FOREIGN PATENT DOCUMENTS

EP 1 365 038 A1 11/2003
WO WO 2006/026882 A1 3/2006

OTHER PUBLICATIONS

European Search Report dated Jan. 7, 2016 in European application 15179473.2, filed on Aug. 3, 2015 (with English Translation).

(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

Nickel-free bulk amorphous alloy, formed, in atomic percent, of:

a zirconium and/or hafnium base, forming the balance, with a total zirconium and hafnium value greater than or equal to 52.0, and less than or equal to 62.0;

copper: greater than or equal to 16.0, and less than or equal to 28.0;

iron: greater than or equal to 0.5, and less than or equal to 10.0;

aluminum: greater than or equal to 7.0, and less than or equal to 13.0;

at least two additional metals taken from the family including Ti, V, Nb, Y, Cr, Mo, Co, Sn, Zn, P, Pd, Ag, Au, Pt, Ta, Ru, Rh, Ir, Os, and Hf when the base contains none, and Zr when the base contains none, (Continued)

with the cumulative atomic percentage of these additional metals being greater then 6.0 and less than or equal to 10.0.

20 Claims, 1 Drawing Sheet

(56) References Cited

U.S. PATENT DOCUMENTS 5,032,196 A * 7/1991 Masumoto ..... C22C 45/10 148/403
5,618,359 A * 4/1997 Lin ..... C22C 45/10 148/403
5,735,975 A * 4/1998 Lin ..... C22C 45/10 148/403
5,772,803 A * 6/1998 Peker ..... F16F 1/021 148/403
5,797,443 A * 8/1998 Lin ..... B22D 46/00 148/403
6,562,156 B2 * 5/2003 Liu ..... C22C 45/10 148/403
6,805,758 B2 * 10/2004 Wolter ..... C22C 45/10 148/403
6,896,750 B2 * 5/2005 Wolter ..... C22C 1/002 148/403
7,153,376 B2 * 12/2006 Wolter ..... C22C 45/10 148/403
2003/0079813 A1 * 5/2003 Zhang ..... C22C 45/10 148/561
2003/0217790 A1 11/2003 Wolter
2004/0216812 A1 11/2004 Wolter
2008/0190521 A1 8/2008 Loffler et al.
2012/0247948 A1 10/2012 Shin et al.
2013/0032252 A1 * 2/2013 He ..... C22C 1/002 148/403
2013/0255837 A1 * 10/2013 Peker ..... C22C 45/10 148/403
2014/0007989 A1 * 1/2014 Prest ..... C22F 1/00 148/537
2015/0159249 A1 * 6/2015 Dubach ..... C22C 16/00 148/403

OTHER PUBLICATIONS

A.Inoue et al. "Recent development and application products of bulk glassy alloys," Acta Materialia, vol. 59, Nov. 18, 2010, www.sciencedirect.com, 25 pages.

* cited by examiner

NICKEL-FREE ZIRCONIUM AND/OR HAFNIUM-BASED BULK AMORPHOUS ALLOY

This application claims priority from European Patent Application No. 15179473.2 filed on Aug. 3, 2015, the entire disclosure of which is hereby incorporated herein by reference.

FIELD OF THE INVENTION

The invention concerns a bulk amorphous alloy.

The invention further concerns a timepiece component made of this type of alloy.

The invention also concerns a watch comprising at least one such component.

The invention concerns the fields of horology and jewellery, in particular for the following structures: watch cases, case middles, main plates, bezels, push-buttons, crowns, buckles, bracelets, rings, earrings and others.

BACKGROUND OF THE INVENTION

Amorphous alloys are increasingly used in the fields of horology and jewellery, in particular for the following structures: watch cases, case middles, main plates, bezels, push-buttons, crowns, buckles, bracelets, rings, earrings and others.

Components for external use, intended to be in contact with the user's skin, must obey certain constraints, due, in particular to the toxicity or allergenic effects of some metals, especially beryllium and nickel. Despite the specific intrinsic properties of such metals, endeavours are made to market alloys containing little or no beryllium or nickel, at least for components likely to come into contact with the user's skin.

Zirconium-based bulk amorphous alloys have been known since the 1990s. The following publications concern such alloys:

[1] Zhang, et al., Amorphous Zr—Al—TM (TM=Co, Ni, Cu) Alloys with Significant Supercooled Liquid Region of Over 100 K, Materials Transactions, JIM, Vol. 32, No. 11 (1991) pp. 1005-1010.

[2] Lin, et al., Effect of Oxygen Impurity on Crystallization of an Undercooled Bulk Glass Forming Zr—Ti—Cu—Ni—Al Alloy, Materials Transactions, JIM, Vol. 38, No. 5 (1997) pp. 473-477.

[3] U.S. Pat. No. 6,592,689.

[4] Inoue, et al., Formation, Thermal Stability and Mechanical Properties of Bulk Glassy Alloys with a Diameter of 20 mm in Zr—(Ti, Nb)—Al—Ni—Cu System, Materials Transactions, JIM, Vol. 50, No. 2 (2009) pp. 388-394.

Amorphous alloys with the best glass forming ability, known as and referred to hereafter as "GFA", and related to the critical diameter $D_c$* are found in the following systems:

Zr—Ti—Cu—Ni—Be, and Zr—Cu—Ni—Al.

The compositions (in atomic %) of the most frequently used/characterized alloys are listed below:

Zr44Ti11Cu9.8Ni10.2Be25 (LM1b)

Zr65Cu17.5Ni10Al7.5 [1]

Zr52.5Cu17.9Ni14.6Al10Ti5 (Vit105) [2]

Zr57Cu15.4Ni12.6Al10Nb5 (Vit106) and Zr58.5Cu15.6Ni12.8Al10.3Nb2.8 (Vit106*a*) [3]

Zr61Cu17.5Ni10Al7.5Ti2Nb2 [4]

Given the allergenic potential of nickel, these alloys cannot be used for applications involving contact with skin, such as external watch parts or suchlike. Further, due to the toxicity of beryllium, the manufacture and machining of some of these alloys require special precautionary measures. This is a pity, because these two elements stabilise the amorphous phase, and make it easier to obtain alloys with a high critical diameter $D_c$*. Further, nickel has a positive effect on the corrosion resistance of zirconium-based amorphous alloys.

However, the critical diameter of nickel-free and beryllium-free zirconium-based amorphous alloys is generally lower than that of alloys containing nickel and beryllium, which is disadvantageous for producing solid parts. There is therefore a need to develop alloys that have a sufficient critical diameter $D_c$*.

SUMMARY OF THE INVENTION

The invention proposes to produce zirconium-based and/or hafnium-based bulk amorphous alloys that are either nickel-free or both nickel-free and beryllium-free, for timepiece applications.

The invention proposes to increase the critical diameter of zirconium-based and/or hafnium-based amorphous alloys that are at least nickel-free or both nickel-free and beryllium-free, while maintaining a high ΔTx value (difference between crystallization temperature Tx and glass transition temperature Tg).

The invention concerns a nickel-free zirconium-based and/or hafnium-based bulk amorphous alloy, with the addition of other elements to increase its critical diameter, according to claim 1.

The invention further concerns a timepiece or jewellery component made of this type of alloy.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
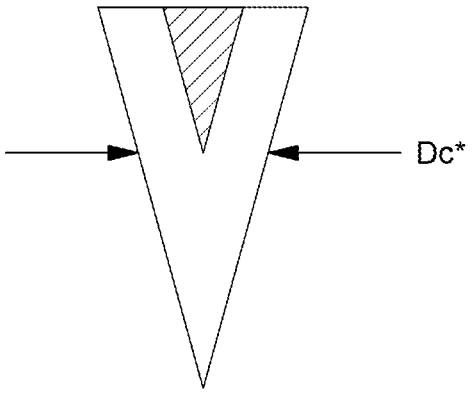
FIG. 1 shows a schematic view of the measurement of critical diameter $D_c$* in a conical sample.
Figure 2:
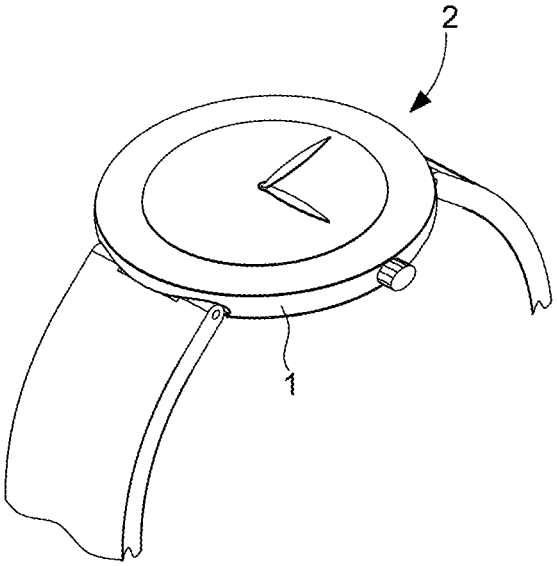
FIG. 2 shows a schematic view of a timepiece made of an alloy according to the invention.

The invention concerns the fields of horology and jewellery, in particular for the following structures: watch cases, case middles, main plates, bezels, push-buttons, crowns, buckles, bracelets, rings, earrings and others.

The invention proposes to produce zirconium-based and/or hafnium-based bulk amorphous alloys that are either nickel-free or both nickel-free and beryllium-free, for timepiece applications, these alloys according to the invention being devised to have similar properties to those of amorphous alloys containing nickel, or containing nickel and beryllium.

The invention proposes to increase the critical diameter of zirconium-based and/or hafnium-based amorphous alloys that are at least nickel-free or both nickel-free and beryllium-free, while maintaining a high ΔTx value.

"Z-free" means that the level of Z in the alloy is preferably zero, or very low, like impurities, and preferably less than or equal to 0.1%.

A "nickel-free alloy" means here an alloy with no nickel, i.e. comprising less than 0.1 atomic percent of nickel, and a "nickel-free and beryllium-free alloy" means an alloy comprising less than 0.1 atomic percent of nickel and comprising less than 0.1 atomic percent of beryllium.

The invention is thus concerned with developing the manufacture of alloys, which include elements substituting nickel, or substituting both nickel and beryllium, which do not cause problems in contact with skin, and which have a high critical diameter value $D_c$* and a high ΔTx value.

The invention therefore concerns a nickel-free zirconium-based and/or hafnium-based bulk, amorphous alloy, with the addition of particular components to increase the critical diameter $D_c$*.

Indeed, the experiments conducted for the present invention established that the possibility of achieving a good external timepiece component, of a given thickness E, made of an amorphous alloy, is closely associated with the critical diameter $D_c$* of the amorphous alloy. In a particularly advantageous embodiment, maximum advantage is taken of critical diameter $D_c$*. Preferably, critical diameter $D_c$* is more than 1.8 times thickness E. More specifically, critical diameter $D_c$* is close to two times thickness E, notably comprised between 1.8 E and 2.2 E.

Various families of nickel-free compositions are already known in the literature, but have low critical diameters and/or poor resistance to corrosion.

A family of zirconium alloys including at least copper and aluminium, notably Zr—Cu—Al and Zr—Cu—Al—Ag is disclosed in the document "Mater Trans, Vol 48, No 7 (2007) 1626-1630". Its known properties are the increase in critical diameter from 8 mm to 12 mm, by adding silver to the alloy, for example by transforming a $Zr_{46}Cu_{46}Al_8$ ally into a $Zr_{42}Cu_{42}Al_8Ag_8$ alloy. Due to the high percentage of copper (ratio Cu/Zr≈1), the corrosion resistance of this family of alloys is very poor and these compositions even tend to become discoloured or blackened over time at ambient temperature. The compositions do not contain iron.

A family of zirconium-based alloys including at least titanium, copper and aluminium, notably Zr—Ti—Cu—Al and Zr—Ti—Nb—Cu—Al, is known from US Patent No. 2013032252. The following alloys, in particular, are known: $Zr_{45-69}Ti_{0.25-8}Cu_{21-35}Al_{7.5-15}$, and $Zr_{45-69}$ (Nb, Ti)$_{0.25-15}Cu_{21-35}Al_{7.5-13}$ with 0.25≤Ti≤8. The compositions do not contain iron. The critical diameter disclosed is less than 10 mm. It should be emphasised that the values displayed in the literature do not always match reality. For example, in the case of US Pat. No. 2013032252, the best compositions are found around Zr60-62Ti2Cu24-28Al10-12. In comparison, the embodiment produced during the experiments of the invention, according to the operating mode described below, of a Zr61Ti2Cu26Al11 alloy supposed to have a critical diameter of 10 mm, only produced a critical diameter $D_c$* of 4.5 mm. This leads to a profound mistrust of the very optimistic results displayed in certain prior art documents.

A family of zirconium alloys including at least palladium, copper and aluminium, of the Zr—Cu—Pd—Al type is known from WO Patent Application No. 2004022118, which discloses a composition with 10% palladium, which is therefore very expensive. The critical diameter remains quite small. The composition does not contain iron.

A family of zirconium alloys including at least niobium, copper and aluminium, of the Zr—Nb—Cu—Al type is known from WO Patent Application No. 013075829. This family permits the manufacture of amorphous alloys using elements that are not very pure, for example utilising industrial zirconium instead of pure zirconium. Consequently, the compositions also include traces of Fe, Co, Hf and O: $Zr_{64.2-72}Hf_{0.01-3.3}$(Fe, Co)$_{0.01-0.15}Nb_{1.3-2.4}O_{0.01-0.13}Cu_{23.3-25.5}Al_{3.4-4.2}$ (mass percent). The critical diameter is close to 5 mm.

A family of zirconium-based alloys including at least niobium, copper, palladium and aluminium, of the Zr—Nb—Cu—Pd—Al type is known from the document "J Mech Behav Biomed, Vol 13 (2012) 166-173", which is concerned with the development of amorphous alloys in the $Zr_{45+x}$—$Cu_{40-x}Al_7Pd_5Nb_3$ system. The compositions do not contain iron. Tests conducted during the development of the invention have demonstrated that these Zr—Nb—Cu—Pd—Al compositions do not resist corrosion.

A family of zirconium-based alloys including at least copper, iron, aluminium and silver, of the Zr—Cu—Fe—Al—Ag type is known from the document "MSEA, Vol 527 (2010) 1444-1447", which studies the influence of Fe on the thermophysical properties of the alloy $(Zr_{46}Cu_{39.2}Ag_{7.8}Al_7)_{100-y}Fe_y$ with 0<y<7. The Cu/Zr ratio is high, and consequently corrosion resistance is not good.

A family of zirconium-based alloys including at least copper, aluminium, and silver, of the Zr—Cu—Fe—Al—X type, where X is at least one element of the family Ti, Hf, V, Nb, Y, Cr, Mo, Fe, Co, Sn, Zn, P, Pd, Ag, Au, Pt, is known from WO Patent Application No. 2006026882 relating to the alloy $Zr_{33-81}Cu_{6-45}$(Fe, Co)$_{3-15}Al_{5-21}$—$X_{0-6}$.

The same family is also known from CN Patent document No. 102534439, which more particularly concerns the alloy $Zr_{60-70}Ti_{1-2.5}Nb_{0-2.5}Cu_{5-15}Fe_{5-15}Ag_{0-10}Pd_{0\ 10}Al_{7.5-12.5}$.

In light of the limitations mentioned in the various disclosures of the literature, the development of the invention has required a significant test campaign to improve the properties, and notably the critical diameter, of amorphous alloys that are nickel-free, and beryllium-free and nickel-free.

Despite the theoretically prohibitive teachings relating to alloys of the type Zr—Cu—Fe—Al—Ag or of the type Zr—Cu—Fe—Al—X, which are not compatible with the specifications and especially as regards corrosion resistance, which must be perfect for external timepiece components, the inventive step sought to establish whether the specific part played by iron, with its advantageous effect on the thermophysical properties of the alloy, could act as the basis for defining particular alloy compositions with a critical diameter $D_c$* preferably greater than or equal to 9 mm, and having very good corrosion resistance, and excellent colour stability over time.

To this end, the invention includes only alloys containing at least 0.5% iron.

Indeed, the Zr—Cu—Fe—Al system is chosen as the starting point, since the literature teaches that this system has a relatively high glass forming ability (GFA) (greater than for ternary Zr—Cu—Al) alloys). Iron was selected chiefly for the following reasons:

- the fact of having 4 elements (Zr—Cu—Al+Fe) increases the complexity of the alloy (it is more difficult to form an ordered structure), and thus increases its GFA;
- generally, the best compositions are found near deep eutectics in the phase diagram. It is known that iron forms a deep eutectic with Zr, and thermodynamic calculations have demonstrated that iron lowers the liquidus in the quaternary system. Deep eutectics are close to Zr60Cu25Fe5Al10 and Zr62.5Cu22.5Fe5Al10;
- further, to increase GFA, the energy of the mixture between the main elements must be negative (which is the case of Zr—Fe and Al—Fe).

However, the critical diameter of Zr—Cu—Fe—Al quaternary alloys is not sufficiently large to form solid external timepiece components, such as a case middle or suchlike. The objective of a critical diameter $D_c$* close to 9 mm or greater than this value, takes account of the fact that, at least in high end watchmaking, the thickness of a case middle is typically close to 5 mm.

The strategy of experimentation consisted in adding additional elements to an initial quaternary alloy in order to increase the critical diameter by using the following main step:

1. Defining a zirconium and/or hafnium base, preferably formed of an initial Zr—Cu—Fe—Al quaternary alloy. For example: $Zr_{58}Cu_{27}Fe_5Al_{10}$. Zirconium may be replaced by hafnium, or by a zirconium-hafnium mixture.
2. Selecting at least two (or more) elements X, taken from a family including Ti, V, Nb, Y, Cr, Mo, Co, Sn, Zn, P, Pd, Ag, Au, Pt, Ta, Ru, Rh, Ir, Os, and Hf when the base contains none, and Zr when the base contains none; in the expression Xa, "a" represents the cumulative percentage of all the X type elements.
3. If a selected X element is among (Ti, Nb, Ta) it replaces Zr. In fact, the elements (Ti, Nb, Ta) are chemically closer to Zr, due to their proximity in the periodic table of elements, and the ease of forming solid solutions with Zr, and they are therefore used to replace Zr.
4. If an X element is among (Pd, Pt, Ag, Au, Ru, Rh, Ir, Os) and therefore, likewise, chemically closer to Cu, it replaces Cu.
5. Maintaining the alloy composition thereby obtained. For example: X1=Nb, and X2=Ag; the selected alloy is $Zr_{58-X1}Nb_{X1}Cu_{25-X2}Ag_{X2}Fe_5Al_{12}$
6. Manufacturing alloys with different X1 and X2 contents. For example, X1 =2% and 3%, and X2=3.5% and 4.5%
7. Measuring the properties and especially the critical diameter $D_c$* of the alloys, and identifying the best composition. For example, $Zr_{56}Nb_2Cu_{22.5}Ag_{4.5}Fe_5Al_{10}$.

For each experimental alloy, alloy charges of around 70 g were prepared in an arc furnace using pure elements (purity of more than 99.95%). The pre-alloy was then melted again in a centrifugal casting machine, with a silicon oxide crucible under argon atmosphere, and cast in a cone-shaped copper mould (maximum thickness 11 mm, width 20 mm, opening angle 6.3°). A metallographic cut was made in the middle of each cone lengthways to measure the critical diameter $D_c$*, which corresponds to the thickness of the cone where the crystalline area starts, as seen in FIG. 1.

The table below summarises the tests performed in a Zr—Cu—Fe—Al—X system, where X is at least one element from the family including Ti, Hf, V, Nb, Y, Cr, Mo, Fe, Co, Sn, Zn, P, Pd, Ag, Au, Pt, Ta, Ru, Rh, Ir, Os.

Compositions 1 and 2 are known, do not include an additional component X, and correspond to the teaching of WO Patent Application No. 2006026882.

Compositions 3 and 4 concern compositions that are not disclosed in the literature, they are however covered by some ranges disclosed by WO Patent Application No. 2006026882. Composition 3 includes a single additional component X which is silver, the critical diameter is better than that of compositions 1 and 2, but insufficient to satisfy the specifications of the invention. Composition 4 includes two additional X components, niobium and silver, with a total percentage of 6, and the critical diameter is on the same order as that of sample 3.

The test campaign demonstrates that the only means of substantially increasing critical diameter $D_c$* is to have a percentage higher than or equal to 6.3.

Compositions 5 to 12 are completely new, and do not overlap with the prior art ranges. They include compositions 5 to 11 which have a critical diameter $D_c$* greater than or equal to 9.5 mm. Composition 12 shows that a cumulative percentage "a" of X components higher than a certain value, in this case 10 atomic percent, has no beneficial effect, on the contrary even, since critical diameter $D_c$* is substantially lower than the preceding ones.

The results show that the addition of X elements increases critical diameter $D_c$* and that ideally at least two X elements should be added to maximise their effect. Tests show that critical diameter $D_c$* is maximum when the cumulated percentage "a" of X elements is between 6 and 10%.

Experiments also prove that the addition of rare earths, in a small quantity, is advantageous to reduce the negative effect of oxygen present in the alloy (oxygen scavengers).

| No | Composition (in atomic percent) | $D_c$* (mm) | Cumulative % of X |
|---|---|---|---|
| 1 | Zr58Cu22Fe8Al10 | 5.0 | 0 |
| 2 | Zr62.5Cu22.5Fe5Al10 | 6.1 | 0 |
| 3 | (Zr58Cu22Fe8Al10)0.95Ag5 | 7.1 | 5 |
| 4 | Zr56Nb2Cu21Ag4Fe5Al12 | 7.0 | 6 |
| 5 | Zr55.9Nb2.1Cu22.8Ag2.1Pd2.1Fe4Al11 | 9.6 | 6.3 |
| 6 | Zr56Ti2Cu22.5Ag4.5Fe5Al10 | 10.5 | 6.5 |
| 7 | Zr56Nb2Cu22.5Ag4.5Fe5Al10 | 10.5 | 6.5 |
| 8 | Zr56Cu22.5Ag4.5Pd2Fe5Al10 | 9.5 | 6.5 |
| 9 | Zr57.5Nb20.5Cu21Ag4.5Fe4.5Al10 | 10 | 7 |
| 10 | Zr56Nb2Cu21.5Ag5.5Fe5Al10 | 10 | 7.5 |
| 11 | Zr55Nb2Cu21.5Ag4.5Pd2Fe5Al10 | 10 | 8.5 |
| 12 | Zr57.5Nb3.5Cu20Ag3.5Pd2Fe3Al10.5 | 6.6 | 9 |

Thus, the invention concerns a second bulk amorphous alloy, wherein it is nickel-free and in that it consists, in atomic percent values, of:

- a base formed of zirconium and/or hafnium, the content of which forms the balance, with a total zirconium and hafnium value greater than or equal to 52.0, and less than or equal to 62.0;
- copper: greater than or equal to 16.0, and less than or equal to 28.0;
- iron: greater than or equal to 0.5, and less than or equal to 10.0;
- aluminium: greater than or equal to 7.0, and less than or equal to 13.0;
- at least a first additional metal and a second additional metal called X taken from the family including Ti, V, Nb, Y, Cr, Mo, Co, Sn, Zn, P, Pd, Ag, Au, Pt, Ta, Ru, Rh, Ir, Os, and Hf when said base contains none, and Zr when said base contains none, with the cumulative atomic percentage "a" of said at least two additional metals being greater then 6.0 and less than or equal to 10.0.

Preferably, when the alloy includes Y, it is in a content greater than 0.5.

More particularly, the first additional metal and the second additional metal are taken from the family including Ti, Nb, Pd, Ag, Au, Pt, Ta, Ru, Rh, Ir, Os, and Hf when said base contains none, and Zr when said base contains none, with the cumulative atomic percentage of said at least two additional metals being greater then 6.0 and less than or equal to 10.0.

More particularly, the first additional metal and the second additional metal are taken from the family including Ti, Nb, Pd, Ag, Au, Pt, Ta, Ru, Rh, Ir, Os, with the cumulative atomic percentage of said at least two additional metals greater then 6.0 and less than or equal to 10.0.

In a specific variant, the alloy according to the invention only contains zirconium and not hafnium.

In another specific variant, the alloy according to the invention only contains hafnium and not zirconium.

More particularly, the alloy according to the invention is nickel-free and beryllium-free.

The best results obtained to date were achieved with:

X=Ag+Nb;

X=Ag+Ti;

X=Nb+Ag+Pd.

In an advantageous variant, the alloy further includes from 0.1-1% of at least one rare earth, taken from a group including scandium, yttrium and lanthanides of atomic numbers 57 to 71, the total of these rare earths being greater than or equal to 0.01, and less than or equal to 1.0.

Among these rare earths, more particularly but in a non-limiting manner, Sc, Y, Nd, Gd are used most frequently.

More particularly still, the alloy according to the invention is cobalt-free and/or chromium-free.

In short, the alloys according to the invention resist corrosion, and have a stable colour (no tarnishing or discolouration during wear).

The following list contains various alloys according to the invention:

Zr52Hf4Nb2Cu21.5Ag5.5Fe5Al10
Zr60Hf2Ta3Cu16Ag5Fe7Al7
Zr56Hf2Ti2Cu21Pd2Fe6Al11
Zr50Hf6Nb2Cu21.5Ag5.5Fe5Al10
Zr40Hf16Nb2Cu21.5Ag5.5Fe5Al10
Zr56Nb1.5Cu21.5Ag3.5Pd1.5Fe3Al13
Zr55Nb3Cu21Ag4.5Pd2.5Fe5Al9
Zr52Ti3.5Nb3.5Cu28Fe5Al8
Zr54Ti5Nb3Cu16Fe10Al12
Zr58.5Ti3.5Ta3Cu20Fe4.5Al10.5
Zr57Ti4.5Cu28Ag2Fe0.5Al8
Zr62Ti2Ta1Cu16Ag4Fe5Al10
Zr54Y2Cu28Ag5Fe3.5Al7.5
Zr54Y1Nb2Cu21.5Ag4.5Pd2Fe5Al10
Zr55Nb2Cu21.5Ag4.5Pt2Fe5Al10
Zr58Cu22.5Ag5Pt2Fe3Co2Al7.5
Zr53Ta3Cu22.5Ag3Au3Fe6Al9.5
Zr57Nb3Cu20Pd3Au2Fe5Al10
Zr58Nb3Cu19Ag2Ru2Fe4.5Al11.5
Zr53Nb2.5Cu24.5Rh4Fe6Al10
Zr56Ti2Cu23Ag3.5Ir1.5Fe3Al11
Zr52Ta2.5Cu24.5Ag3.5Os2.5Fe5Al10
Zr56Nb2Cu21.5Ag5.5Fe5Al8Sn2
Zr55Nb2Cu22.5Ag3.5Pd2Fe4.5Al9Sn1.5
Zr54Ti2.5Cu21Ag5.5Fe5Al10.5Zn1.5
Zr61Nb2Cu16.5Pd2.5Fe8Al8Zn2
Zr54Nb2.5Cu18.5Ag4.5Fe9Al10P1.5
Zr56Nb2Cu21.5Ag3.5Pd2Fe5Al8P2
Zr60N b3Cu17.5Ag3Fe4Cr2Al10.5
Zr53Nb2Cu24.5Ag2.5Pd2Fe4Cr2Al10
Zr57Ta3Cu20Ag2Fe5Co3Al10
Zr55Ti2.5Nb2.5Cu24.5Fe3.5Co2.5Al9.5
Zr59Nb2Cu18Pd3Fe4.5V2.5Al11
Zr56Ti3Cu22.5Ag4.5Fe2.5V1.5Al10
Zr55Ti2.5Cu24Ag2.5Fe3.5Mo2.5Al10
Zr52Nb2Cu26Ag4.5Fe4Mo1.5Al9Sn1

The invention further concerns a timepiece or jewellery component made of such an amorphous alloy.

More specifically the critical diameter $D_c$* of the amorphous alloy of the invention, which forms this component, is more than 1.8 times the greatest thickness E of component 1.

The invention also concerns a watch 2 including at least one such external component 1.

More particularly, watch 2 includes such an external component 1 which is a case middle of maximum thickness E comprised between 4.0 and 5.0 mm made of such an amorphous alloy having a critical diameter $D_c$* of more than 8 mm.

What is claimed is:

1. A bulk amorphous alloy that contains no nickel and consists of, in atomic percent values:

a base formed of zirconium and/or hafnium, the content of which forms the balance, with a total zirconium and hafnium value greater than or equal to 52.0, and less than or equal to 62.0;

copper: greater than or equal to 16.0, and less than or equal to 28.0;

iron: greater than or equal to 0.5, and less than or equal to 10.0;

aluminum: greater than or equal to 7.0, and less than or equal to 13.0;

a first additional metal Ag and at least one second additional metal X, wherein said at least one second additional metal X is selected from the group consisting of Ti, V, Nb, Y, Cr, Mo, Co, Sn, Zn, P, Pd, Au, Pt, Ta, Ru, Rh, Ir, Os, Hf when said base contains none, and Zr when said base contains none, with the cumulative atomic percentage of said first additional metal and said at least one second additional metal being greater than 6.0 and less than or equal to 10.0.

2. The bulk amorphous alloy according to claim 1, wherein said at least one second additional metal is selected from the group consisting of Ti, Nb, Pd, Au, Pt, Ta, Ru, Rh, Ir, Os, Hf when said base contains none, and Zr when said base contains none.

3. The bulk amorphous alloy according to claim 2, wherein said at least one second additional metal is selected from the group consisting of Ti, Nb, Pd, Au, Pt, Ta, Ru, Rh, Ir, and Os.

4. The bulk amorphous alloy according to claim 1, wherein said alloy includes, in atomic percentage value, yttrium being greater than or equal to 0.01, and less than or equal to 1.0.

5. The bulk amorphous alloy according to claim 1 wherein said alloy is nickel-free and beryllium-free.

6. The bulk amorphous alloy according to claim 1 wherein said alloy is being cobalt-free and/or chromium-free.

7. The bulk amorphous alloy according to claim 1, wherein when yttrium is present in said alloy, the content thereof is greater than 0.5.

8. A timepiece or jewelry component comprising the amorphous alloy according to claim 1.

9. The timepiece or watch component according to claim 8, wherein the critical diameter of said amorphous alloy which forms said component is greater than 1.8 times the greatest thickness of said component of thickness E.

10. A watch comprising at least one component according to claim 8, wherein said component is an external component.

11. The watch according to claim 10, wherein said external component is a case middle of maximum thickness between 4.0 and 5.0 mm made of said amorphous alloy and having a critical diameter of more than 8 mm.

12. The bulk amorphous alloy according to claim 1, wherein said first additional metal and said at least one second additional metal is a combination selected from the group consisting of Ag and Nb, Ag and Ti, and Nb, Ag, and Pd.

13. An amorphous alloy that contains no nickel comprising in atomic percent values:

a base formed of zirconium or hafnium, or both zirconium and hafnium, wherein the total amount of zirconium and hafnium ranges from 52.0 to 62.0;

copper in an amount ranging from 16.0 to 28.0;

iron in an amount ranging from 0.5 to 10.0;

aluminum in an amount ranging from 7.0 to 13.0;

a first additional metal Ag and at least one second additional metal, wherein said at least one second additional metal is selected from the group consisting of Ti, V, Nb, Y, Cr, Mo, Co, Sn, Zn, P, Pd, Au, Pt, Ta, Ru, Rh, Ir, Os, Hf when the base contains none, and Zr when the base contains none, in a cumulative amount ranging from 6.0 to 10.0.

14. The amorphous alloy of claim 13, wherein the base contains no hafnium.

15. The amorphous alloy of claim 13, wherein the base contains no zirconium.

16. The amorphous alloy of claim 13 that contains no beryllium.

17. An horological or jewelry structure or component comprising the amorphous alloy of claim 13.

18. A watch component comprising the amorphous alloy of claim 13.

19. Wearable jewelry comprising the amorphous alloy of claim 13.

20. A bulk amorphous alloy that contains no nickel and consists of, in atomic percent values:

a base formed of zirconium and/or hafnium, the content of which forms the balance, with a total zirconium and hafnium value greater than or equal to 52.0, and less than or equal to 62.0;

copper: greater than or equal to 16.0, and less than or equal to 28.0;

iron: greater than or equal to 0.5, and less than or equal to 10.0;

aluminum: greater than or equal to 7.0, and less than or equal to 13.0;

yttrium: greater than 0.5, and less than or equal to 1.0;

two or more additional metals X selected from the group consisting of Ti, V, Nb, Cr, Mo, Co, Sn, Zn, P, Pd, Ag, Au, Pt, Ta, Ru, Rh, Ir, Os, Hf when said base contains none, and Zr when said base contains none, with the cumulative atomic percentage of said two or more additional metals being greater than 6.0 and less than or equal to 10.0.

* * * * *